US011177612B2

(12) United States Patent
Chiang et al.

(10) Patent No.: US 11,177,612 B2
(45) Date of Patent: Nov. 16, 2021

(54) PLUG CONNECTOR WITH A CONNECTOR POSITION ASSURANCE DEVICE AND CONNECTOR ASSEMBLY INCLUDING THE SAME

(71) Applicant: Cheng Uei Precision Industry Co., LTD., New Taipei (TW)

(72) Inventors: Chih-Hsien Chiang, New Taipei (TW); Sheng-Nan Yu, New Taipei (TW); Chun-Fu Lin, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/107,815

(22) Filed: Nov. 30, 2020

(65) Prior Publication Data

US 2021/0210900 A1 Jul. 8, 2021

(30) Foreign Application Priority Data

Jan. 8, 2020 (CN) ..... 202020044861.0

(51) Int. Cl.

| | |
|---|---|
| ***H01R 13/641*** | (2006.01) |
| ***H01R 13/627*** | (2006.01) |
| ***H01R 13/639*** | (2006.01) |
| ***H01R 13/436*** | (2006.01) |

(52) U.S. Cl.

CPC ..... *H01R 13/6272* (2013.01); *H01R 13/436* (2013.01); *H01R 13/639* (2013.01); *H01R 13/641* (2013.01)

(58) Field of Classification Search

CPC ..... H01R 13/6272; H01R 13/436; H01R 13/639; H01R 13/641

See application file for complete search history.

(56) References Cited

U.S. PATENT DOCUMENTS

| | | | | |
|---|---|---|---|---|
| 5,910,027 | A * | 6/1999 | Wayt | H01R 13/641 439/489 |
| 10,505,314 | B1 * | 12/2019 | Yi | H01R 13/641 |
| 2004/0248453 | A1 * | 12/2004 | McLauchlan | H01R 13/6272 439/352 |
| 2017/0352985 | A1 * | 12/2017 | Venkatesan | H01R 43/26 |
| 2020/0212627 | A1 * | 7/2020 | Saito | H01R 13/639 |
| 2021/0281011 | A1 * | 9/2021 | Chiang | H01R 13/502 |

* cited by examiner

*Primary Examiner* — Tho D Ta

(74) *Attorney, Agent, or Firm* — Cheng-Ju Chiang

(57) ABSTRACT

A plug connector with a connector position assurance device adapted for being docked with a socket connector, includes a main body, a plurality of terminals, a plurality of cables connected with the plurality of the terminals, and a connector position assurance device. The main body has a plurality of terminal slots. A top of the main body is bent frontward to form a buckling portion. The main body is spaced from the buckling portion and the two locking portions to form a locating space among the main body, the buckling portion and the two locking portions. The plurality of the terminals are assembled in the plurality of the terminal slots. The connector position assurance device has an abutting block. When the plug connector with a connector position assurance device is inserted into the socket connector, the abutting block moves into the locating space.

11 Claims, 16 Drawing Sheets

PLUG CONNECTOR WITH A CONNECTOR POSITION ASSURANCE DEVICE AND CONNECTOR ASSEMBLY INCLUDING THE SAME

CROSS-REFERENCE TO RELATED APPLICATION

The present application is based on, and claims priority from, China Patent Application No. 202020044861.0, filed Jan. 8, 2020, the disclosure of which is hereby incorporated by reference herein in its entirety.

BACKGROUND OF THE INVENTION

1. Field of the Invention

The present invention generally relates to a plug connector, and more particularly to a plug connector with a connector position assurance device which is capable of maintaining an insertion and connection status between the plug connector with a connector position assurance device, and a socket connector, and a connector assembly including the plug connector with a connector position assurance device, and the socket connector.

2. The Related Art

A conventional plug connector is adapted for being connected with a socket connector. The conventional plug connector includes a snap portion configured to and engaged with the socket connector, so that the conventional plug connector and the socket connector enter an insertion and connection status. However, this above-mentioned way of connecting the conventional plug connector and the socket connector is apt to disengage the conventional plug connector from the socket connector on account of pressing on the conventional plug connector by an external force.

Therefore, it is necessary to provide an innovative plug connector with a connector position assurance device, and a connector assembly. The innovative plug connector with a connector position assurance device is capable of maintaining an insertion and connection status between the plug connector with a connector position assurance device, and a socket connector. The connector assembly includes the plug connector with a connector position assurance device, and the socket connector.

SUMMARY OF THE INVENTION

An object of the present invention is to provide a plug connector with a connector position assurance device adapted for being docked with a socket connector. The plug connector with a connector position assurance device, and the socket connector are capable of maintaining an insertion and connection status between the plug connector with a connector position assurance device, and the socket connector. The plug connector with a connector position assurance device includes a main body, a plurality of terminals, a plurality of cables and a connector position assurance device. The main body has a plurality of terminal slots longitudinally penetrating through a front surface and a rear surface of the main body. Two sides of a top of the main body protrude upward to form two locking portions spaced from each other. A rear of the top of the main body is protruded upward and then is bent frontward to form a buckling portion projecting into an interval between the two locking portions. The top of the main body is spaced from a front end of the buckling portion and the two locking portions to form a locating space among the top of the main body, the front end of the buckling portion and the two locking portions. The plurality of the terminals are assembled in the plurality of the terminal slots. Two opposite ends of each terminal have a connecting end and a fitting end. The plurality of the cables are connected with the connecting ends of the plurality of the terminals. The connector position assurance device has a latching assembly extended rearward and located to two opposite sides of the connector position assurance device, and an abutting block protruded rearward and located between two sides of the latching assembly. The abutting block is arranged corresponding to the locating space. When the plug connector with a connector position assurance device is inserted into the socket connector, the two sides of the latching assembly being arranged corresponding to outer surfaces of the two locking portions, and the latching assembly is combined with the socket connector, the abutting block moves into the locating space, the front end of the buckling portion abuts against the abutting block at the time of the front end of the buckling portion being pressed downward on the abutting block, at the moment, the locating space is filled up to make the buckling portion be unable to be pressed downward and towards the abutting block, and a connecting status of the socket connector, and the plug connector with a connector position assurance device is maintained.

Another object of the present invention is to provide a connector assembly. The connector assembly includes a socket connector, and a plug connector with a connector position assurance device. The plug connector with a connector position assurance device includes a main body, a plurality of terminals, a plurality of cables and a connector position assurance device. The main body has a plurality of terminal slots longitudinally penetrating through a front surface and a rear surface of the main body. Two sides of a top of the main body protrudes upward to form two locking portions spaced from each other. A rear of the top of the main body is protruded upward and then is bent frontward to form a buckling portion projecting into an interval between the two locking portions. The top of the main body is spaced from a front end of the buckling portion and the two locking portions to form a locating space among the top of the main body, the front end of the buckling portion and the two locking portions. The plurality of the terminals are assembled in the plurality of the terminal slots. Two opposite ends of each terminal has a connecting end and a fitting end. The plurality of the cables are connected with the connecting ends of the plurality of the terminals. The connector position assurance device has a latching assembly extended rearward and located to two opposite sides of the connector position assurance device, and an abutting block protruded rearward and located between two sides of the latching assembly. The abutting block is arranged corresponding to the locating space. When the plug connector with a connector position assurance device is inserted into the socket connector, the two sides of the latching assembly being arranged corresponding to outer surfaces of the two locking portions, and the latching assembly is combined with the socket connector, the abutting block moves into the locating space, the front end of the buckling portion abuts against the abutting block at the time of the front end of the buckling portion being pressed downward on the abutting block, at the moment, the locating space is filled up to make the buckling portion be unable to be pressed downward and towards the abutting block, and a connecting status of the socket connector, and the plug connector with a connector position assurance device is maintained.

Another object of the present invention is to provide a plug connector with a connector position assurance device adapted for being docked with a socket connector. The plug connector with a connector position assurance device includes a main body, a plurality of terminals, a plurality of cables and a connector position assurance device. The main body has a plurality of terminal slots longitudinally penetrating through a front surface and a rear surface of the main body. At least one side of a top of the main body protrudes upward to form at least one locking portion. The at least one locking portion defines a locking hole longitudinally penetrating through middles of a front surface and a rear surface of the at least one locking portion. A rear of the top of the main body is protruded upward and then is bent frontward to form a buckling portion extending to one side of the at least one locking portion. The top of the main body is spaced from a front end of the buckling portion and the at least one locking portion to form a locating space among the top of the main body, the front end of the buckling portion and the at least one locking portion. The plurality of the terminals are assembled in the plurality of the terminal slots. Two opposite ends of each terminal have a connecting end and a fitting end. The plurality of the cables are connected with the connecting ends of the plurality of the terminals. The connector position assurance device has a latching assembly extended rearward and located to at least one side of the connector position assurance device, and an abutting block protruded rearward and adjacent to an inner side of the latching assembly. The abutting block is arranged corresponding to the locating space. When the plug connector with a connector position assurance device is inserted into the socket connector, the latching assembly is arranged corresponding to an outer surface of the at least one locking portion, and the latching assembly is combined with the socket connector, the abutting block moves into the locating space, the front end of the buckling portion abuts against the abutting block at the time of the front end of the buckling portion being pressed downward on the abutting block, at the moment, the locating space is filled up to make the buckling portion be unable to be pressed downward and towards the abutting block, and a connecting status of the socket connector, and the plug connector with a connector position assurance device is maintained.

As described above, when the plug connector with a connector position assurance device is inserted into the socket connector, the abutting block keeps contacting with and abutting against the buckling portion by virtue of the connector position assurance device being assembled to the plug connector with a connector position assurance device, and the socket connector, so that the plug connector with a connector position assurance device, and the socket connector of the connector assembly are capable of maintaining an insertion and connection status between the plug connector with a connector position assurance device, and the socket connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
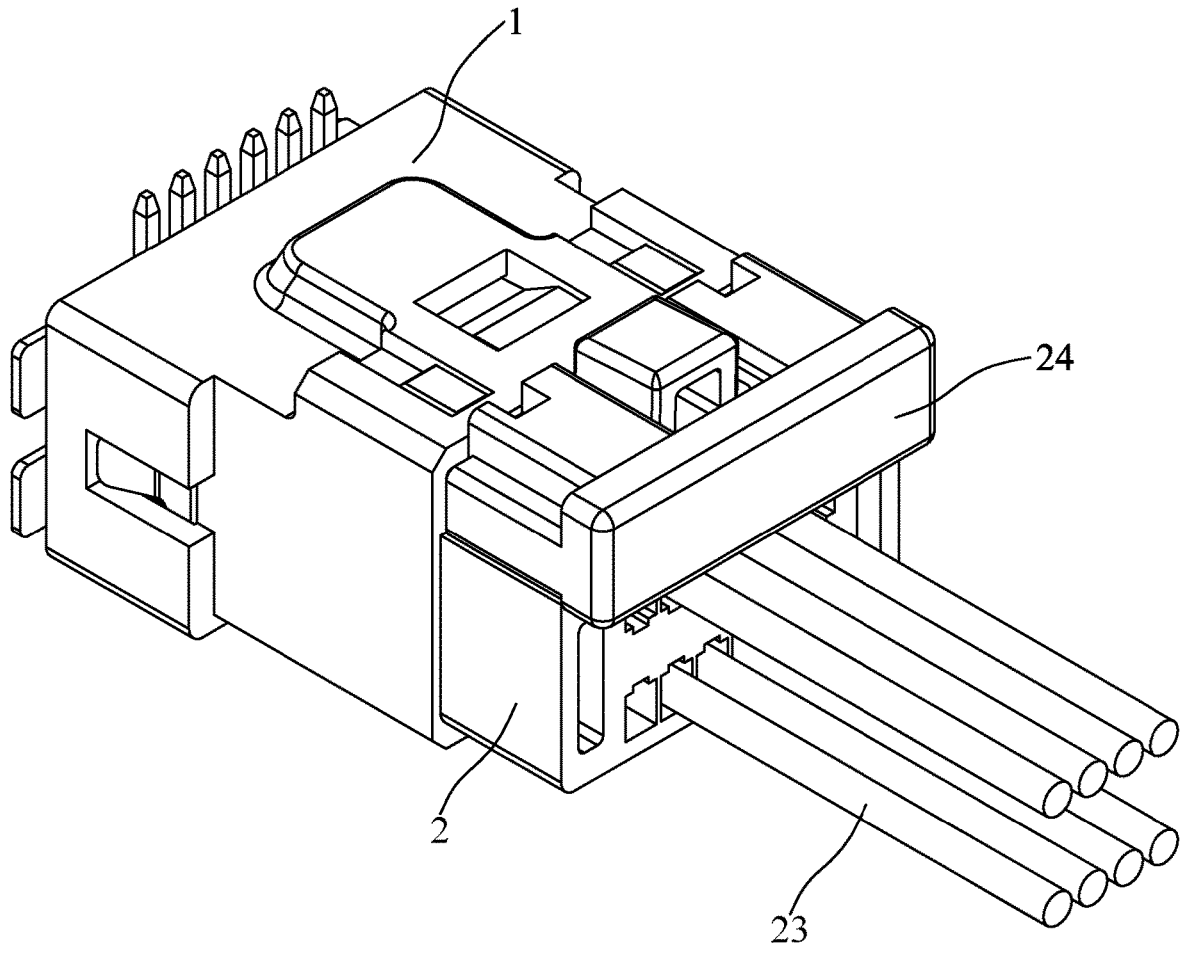
FIG. 1 is a perspective view of a connector assembly in accordance with a preferred embodiment of the present invention, wherein the connector assembly includes a plug connector with a connector position assurance device, and a socket connector which are matched with and engaged with each other.
Figure 2:
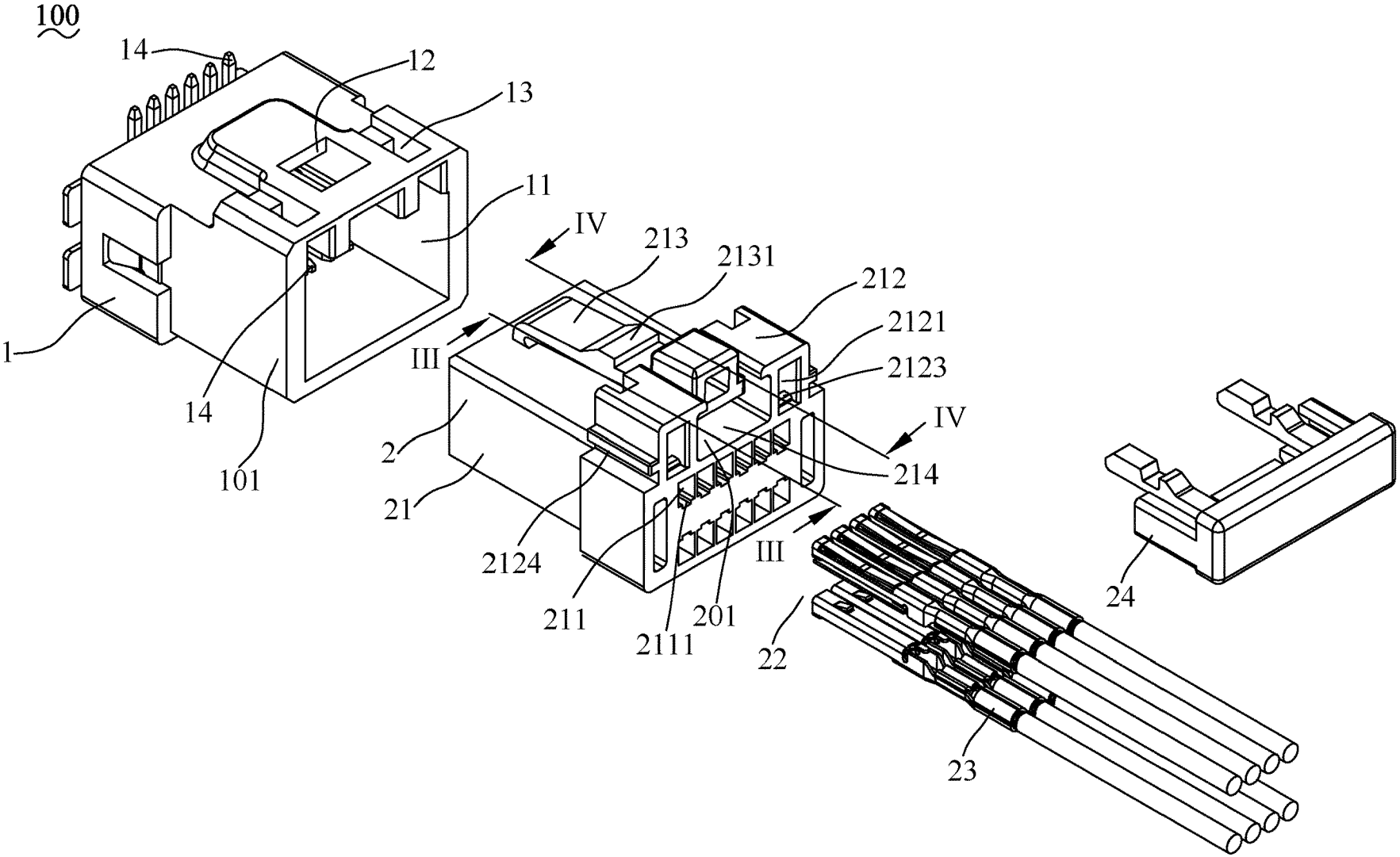
FIG. 2 is an exploded view of the connector assembly of FIG. 1.

Referring to FIG. 1 and FIG. 2, a connector assembly 100 in accordance with a preferred embodiment of the present invention is shown. The connector assembly 100 includes a socket connector 1, and a plug connector with a connector position assurance device 2. The plug connector with a connector position assurance device 2 is adapted for being docked with the socket connector 1. The plug connector with a connector position assurance device 2, and the socket connector 1 are electrical connectors.

Figure 13:
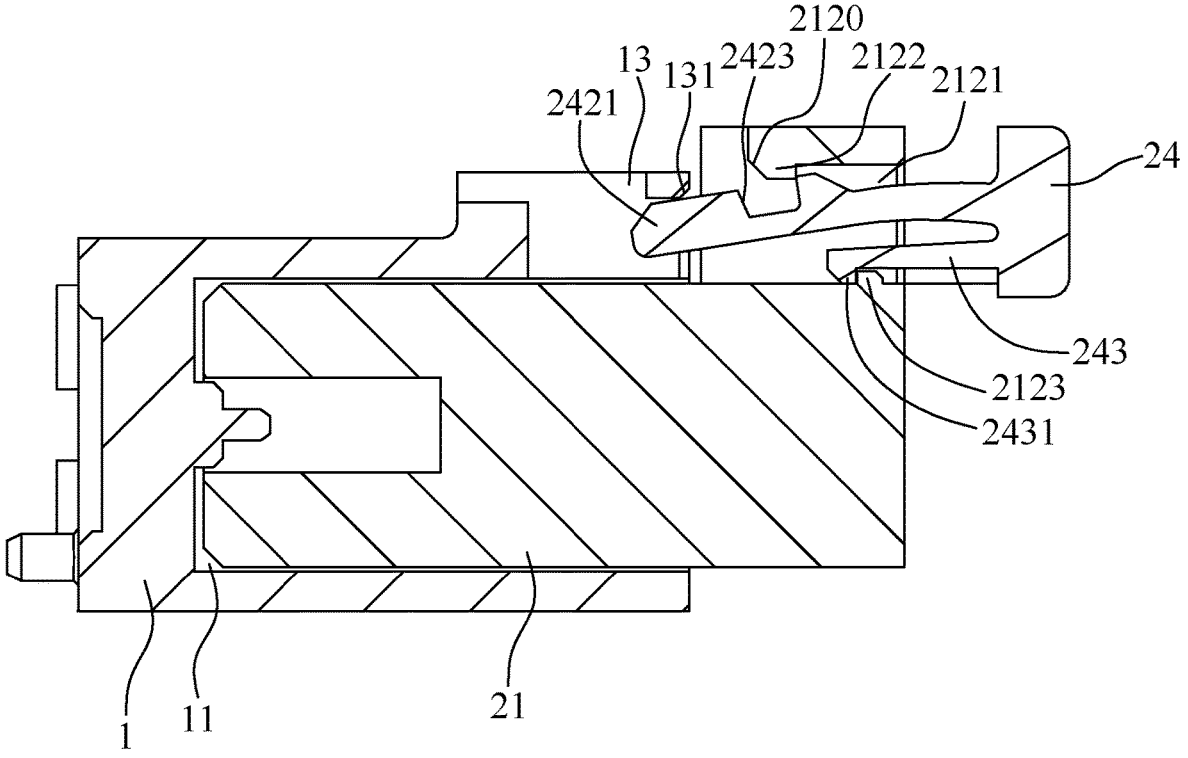
FIG. 13 is a sectional view of the plug connector with a connector position assurance device, and the socket connector along a line XIII-XIII of FIG. 9.
Figure 14:
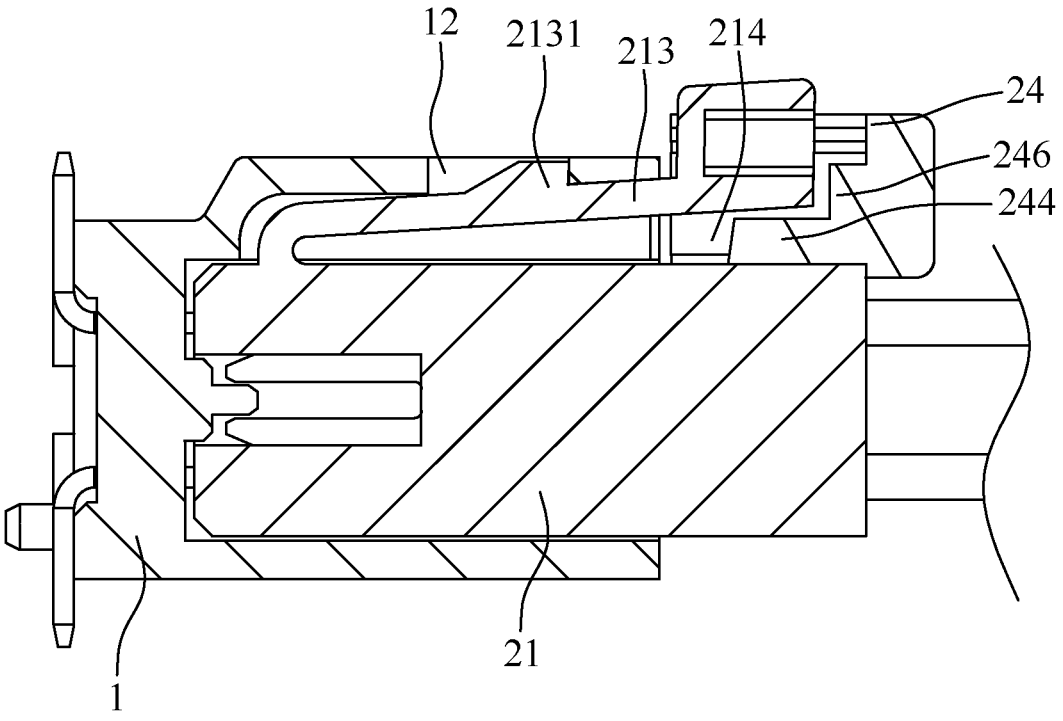
FIG. 14 is a sectional view of the plug connector with a connector position assurance device, and the socket connector along a line XIV-XIV of FIG. 10.
Figure 15:
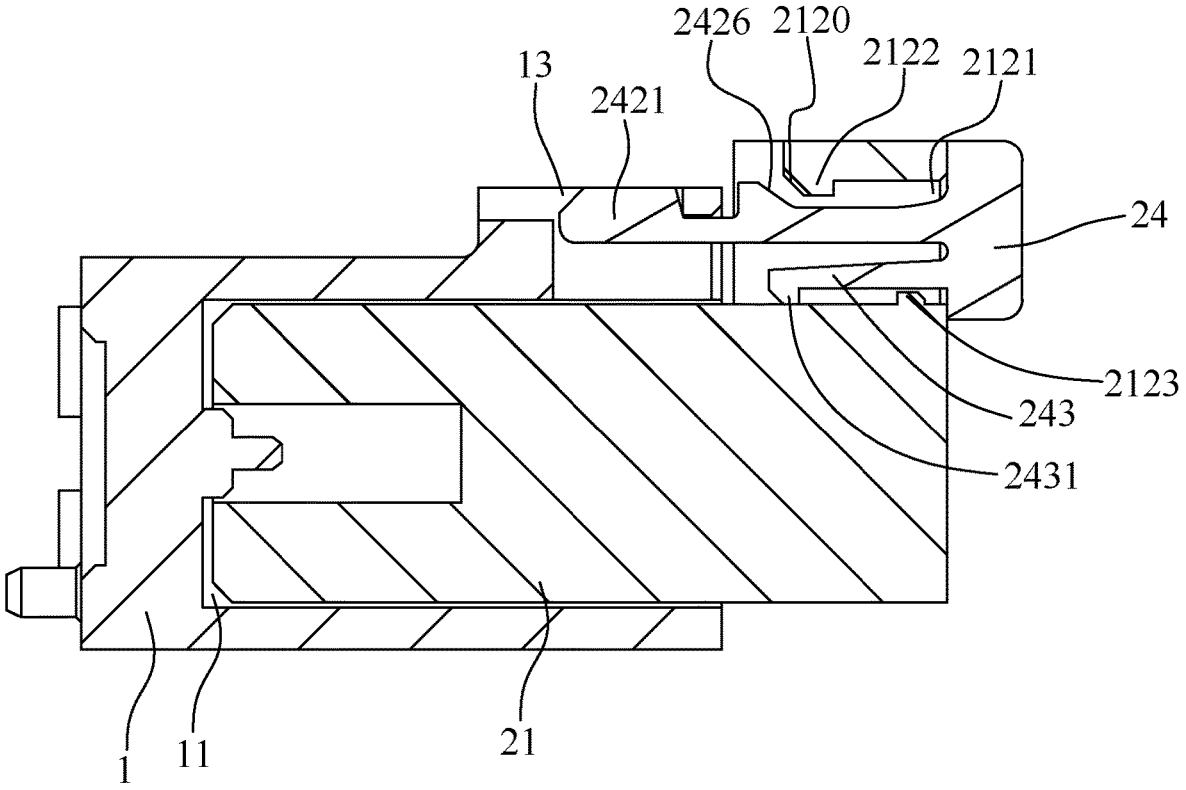
FIG. 15 is a sectional view of the plug connector with a connector position assurance device, and the socket connector along a line XV-XV of FIG. 10.
Figure 16:
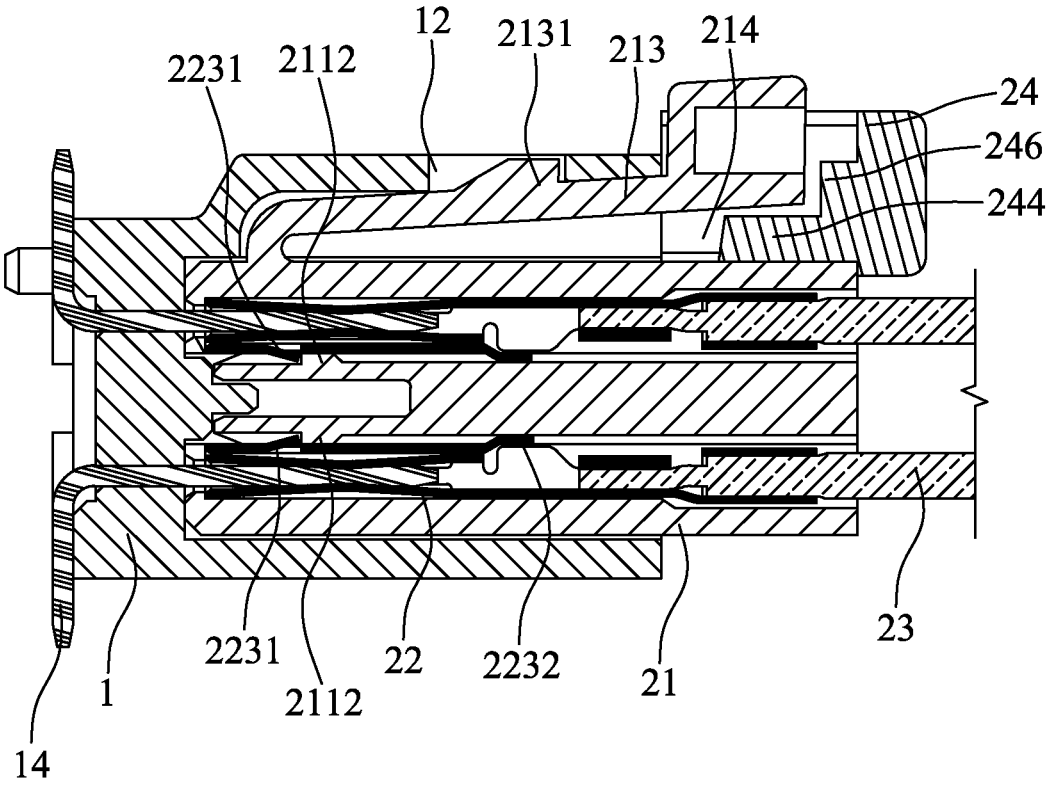
FIG. 16 is a sectional view of the plug connector with a connector position assurance device, and the socket connector of the connector assembly in accordance with the present invention.

Referring to FIG. 1, FIG. 2 and FIG. 13, the socket connector 1 includes a rectangular base body 101 and a plurality of contact pins 14. A middle of a front of the base body 101 of the socket connector 1 is recessed rearward to form an insertion space 11 for receiving the plug connector with a connector position assurance device 2. The plug connector with a connector position assurance device 2 is matched with the insertion space 11 of the socket connector 1. The plug connector with a connector position assurance device 2 is inserted into and connected with the insertion space 11 of the socket connector 1. The plug connector with a connector position assurance device 2 is cooperated with the insertion space 11 of the socket connector 1. A front of a top of the base body 101 defines a first buckling hole 12 vertically penetrating through the front of the top of the base body 101 and communicated with the insertion space 11. At least one side of the top of the base body 101 of the socket connector 1 defines at least one second buckling hole 13 vertically penetrating through the top of the base body 101 and communicated with the insertion space 11. A lower portion of a front surface of a top wall of the at least one second buckling hole 13 is inclined rearward from top to bottom to form a first guiding surface 131.

In the preferred embodiment, two sides of the top of the base body 101 of the socket connector 1 define two second buckling holes 13 vertically penetrating through the top of the base body 101 and communicated with the insertion space 11. The two second buckling holes 13 are spaced from each other. The first buckling hole 12 is located between the two second buckling holes 13. The insertion space 11 is equipped with the plurality of the contact pins 14. A configuration of the plurality of the contact pins 14 and a circuit board (not shown) applies appropriate technologies. The plurality of the contact pins 14 are soldered to the circuit board by a SMD (Surface Mounted Device) Technology, a PIP (Pin In Paste) technology or etc.

Referring to FIG. 2, the plug connector with a connector position assurance device 2 includes a main body 21, a plurality of terminals 22, a plurality of cables 23 and a connector position assurance (CPA) device 24.

Referring to FIG. 2 to FIG. 16, the main body 21 has a plurality of terminal slots 211 longitudinally penetrating through a front surface and a rear surface of the main body 21. In the preferred embodiment, the main body 21 has two rows of the terminal slots 211. The two rows of the terminal slots 211 are arranged into an upper row of the terminal slots 211 and a lower row of the terminal slots 211. The terminal slots 211 in the upper row are opposite to the terminal slots 211 in the lower row. Each terminal slot 211 has a locating slot 2111 recessed inward. Inner surfaces of bottom walls of the terminal slots 211 arranged in the upper row are recessed downward to form an upper row of the locating slots 2111. Inner surfaces of top walls of the terminal slots 211 arranged in the lower row are recessed inward and towards the upper row of the terminal slots 211 to form a lower row of the locating slots 2111. The locating slots 2111 in the upper row are opposite to the locating slots 2111 in the lower row. Rears of side walls of the locating slots 2111 arranged in the upper row are disconnected from rears of side walls of the terminal slots 211 arranged in the upper row. Rears of side walls of the locating slots 2111 arranged in the lower row are disconnected from rears of side walls of the terminal slots 211 arranged in the lower row.

Each locating slot 2111 has a limiting block 2112 protruded inward and extended from a wall of the locating slot 2111. A rear of an inner surface of a bottom wall of each locating slot 2111 in the upper row protrudes upward to form the limiting block 2112. A rear of an inner surface of a top wall of each locating slot 2111 in the lower row protrudes downward to form the limiting block 2112. At least one side of a top of the main body 21 protrudes upward to form at least one locking portion 212. The at least one locking portion 212 defines a locking hole 2121 longitudinally penetrating through middles of a front surface and a rear surface of the at least one locking portion 212. A rear of a top wall of the locking hole 2121 of the at least one locking portion 212 protrudes downward to form a first locking block 2122. A front of a bottom wall of the locking hole 2121 of the at least one locking portion 212 protrudes upward to form a second locking block 2123. A lower portion of an outer surface of the at least one locking portion 212 protrudes outward to form a sliding block 2124. A lower portion of a rear surface of the locking hole 2121 of the at least one locking portion 212 is inclined frontward from top to bottom to form a second guiding surface 2120. A rear of the top of the main body 21 is protruded upward and then is bent frontward to form a buckling portion 213 extending to one side of the at least one locking portion 212. The top of the main body 21 is spaced from a front end of the buckling portion 213 and the at least one locking portion 212 to form a locating space 214 among the top of the main body 21, the front end of the buckling portion 213 and the at least one locking portion 212.

Two sides of the top of the main body 21 protrude upward to form two locking portions 212 spaced from each other. The two locking portions 212 define two locking holes 2121 longitudinally penetrating through middles of front surfaces and rear surfaces of the two locking portions 212. Rears of top walls of the two locking holes 2121 protrude downward to form two first locking blocks 2122. Fronts of bottom walls of the two locking holes 2121 protrude upward to form two second locking blocks 2123. Lower portions of outer surfaces of the two locking portions 212 protrude outward to form two sliding blocks 2124. A lower portion of a rear surface of each locking hole 2121 is inclined frontward from top to bottom to form the second guiding surface 2120. The rear of the top of the main body 21 is protruded upward and then is bent frontward to form the buckling portion 213 projecting into an interval 201 between the two locking portions 212. The top of the main body 21 is spaced from the front end of the buckling portion 213 and the two locking portions 212 to form the locating space 214 among the top of the main body 21, the front end of the buckling portion 213 and the two locking portions 212. A middle of the buckling portion 213 is arched upward to form a first buckling block 2131. The first buckling block 2131 is positioned corresponding to the first buckling hole 12.

Referring to FIG. 2, FIG. 4, FIG. 5 and FIG. 16, the plurality of the terminals 22 are assembled in the plurality of the terminal slots 211. Two opposite ends of each terminal 22 has a connecting end 221 and a fitting end 222. A front end of each terminal 22 is defined as the connecting end 221, and a rear end of each terminal 22 is defined as the fitting end 222. The connecting end 221 is shaped as a tube. The plurality of the cables 23 are connected with the connecting ends 221 of the plurality of the terminals 22. A top of a middle of each terminal 22 is opened freely to form an opening 224. Two side walls of the opening 224 are bent towards each other and are further curved downward to form two semicircular clamping portions 2211. The two clamping portions 2211 are extendable along a lengthwise direction of each terminal 22 to provide a larger contacting area between one cable 23 and each terminal 22 that is connected with the one cable 23. The fitting end 222 is shown as a hollow shape. The fitting end 222 of each terminal 22 is configured to cooperate with a contact pin, in the preferred embodiment, the fitting end 222 of each terminal 22 is formed into a box-shape beam with a rear end of the fitting end 222 being opened to receive one contact pin 14 shown in FIG. 2.

It should be understood that a pattern of the fitting end 222 of each terminal 22 is without being limited to be the box-shape beam, other patterns of the fitting end 222 may be also appropriate. The terminal 22 further has a first positioning portion 2231 punched upward from a top of the fitting end 222. The first positioning portion 2231 is extended and located between the connecting end 221 and a rear end of the fitting end 222. A top of a front end of the fitting end 222 slantwise extends frontward and upward, and then extends frontward to form a second positioning portion 2232. The second positioning portion 2232 is extended and located between the first positioning portion 2231 and the connecting end 221. The first positioning portion 2231 and the second positioning portion 2232 of each terminal 22 are arranged in one locating slot 2111. The first positioning portion 2231 of each terminal 22 is blocked by a rear end of the limiting block 2112 of the one locating slot 2111, and the second positioning portion 2232 is arranged away from and located in front of the limiting block 2112 of the one locating slot 2111. The first positioning portion 2231 and the second positioning portion 2232 of each terminal 22 maintain each terminal 22 within one terminal slot 211 and the one locating slot 2111 to be located in a constant position of the one terminal slot 211 and the one locating slot 2111 for preventing a displacement of each terminal 22. The plurality of the cables 23 are connected to the connecting ends 221 of the plurality of the terminals 22.

Figure 3:
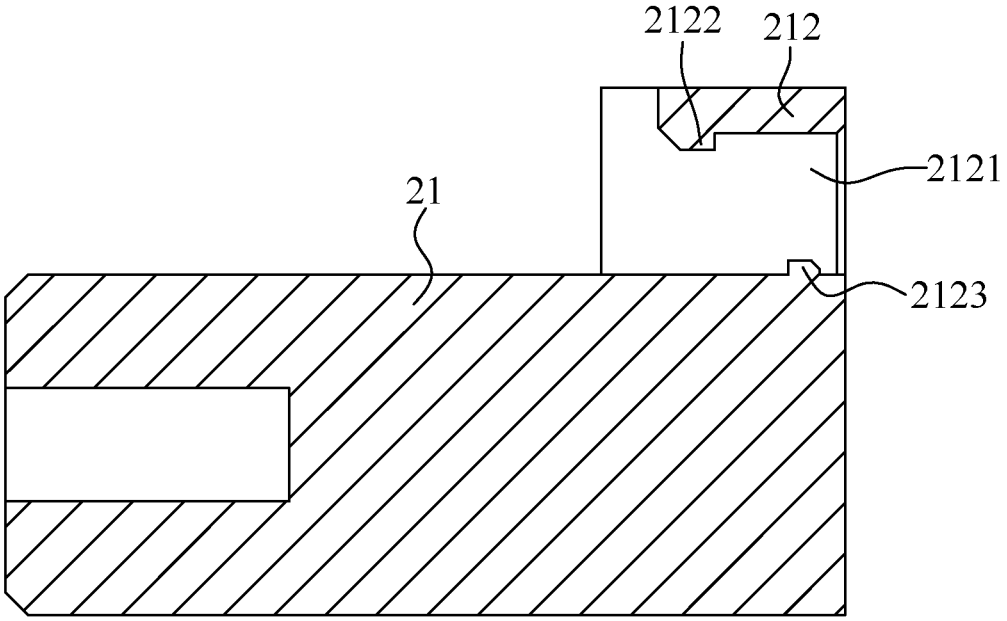
FIG. 3 is a sectional view of the plug connector with a connector position assurance device along a line III-III of FIG. 2.
Figure 4:
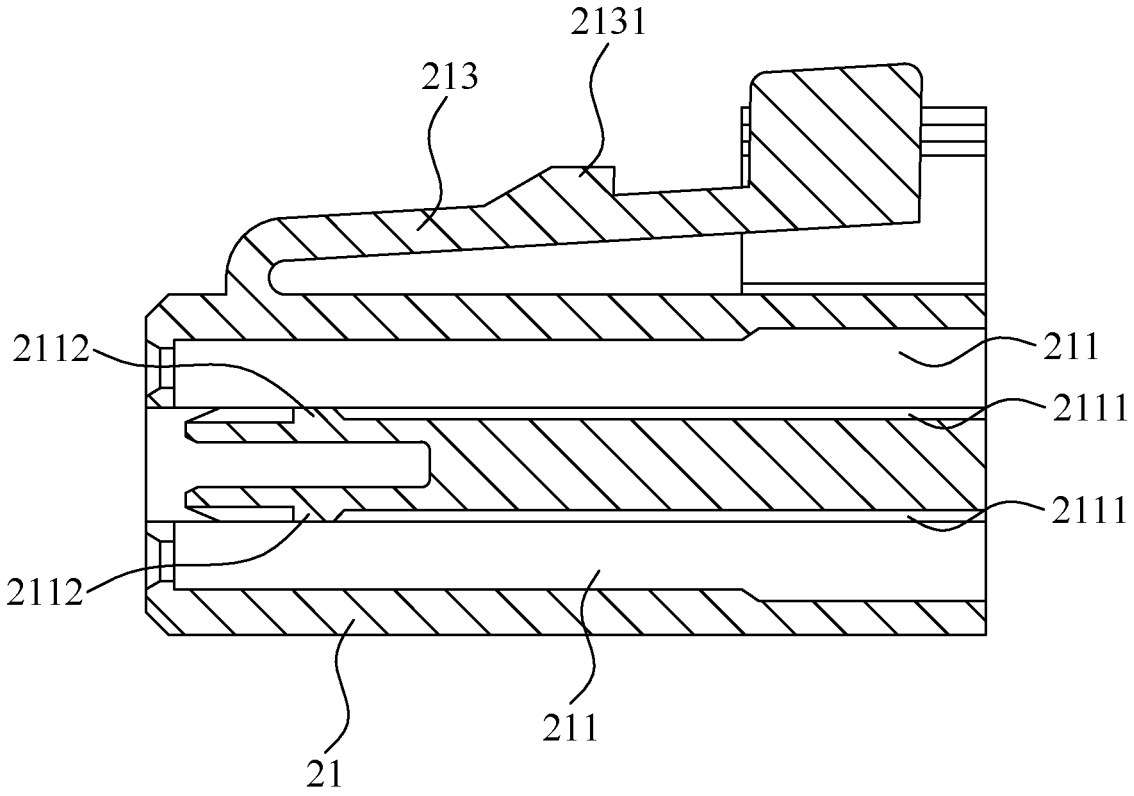
FIG. 4 is a sectional view of the plug connector with a connector position assurance device along a line IV-IV of FIG. 2.
Figure 5:
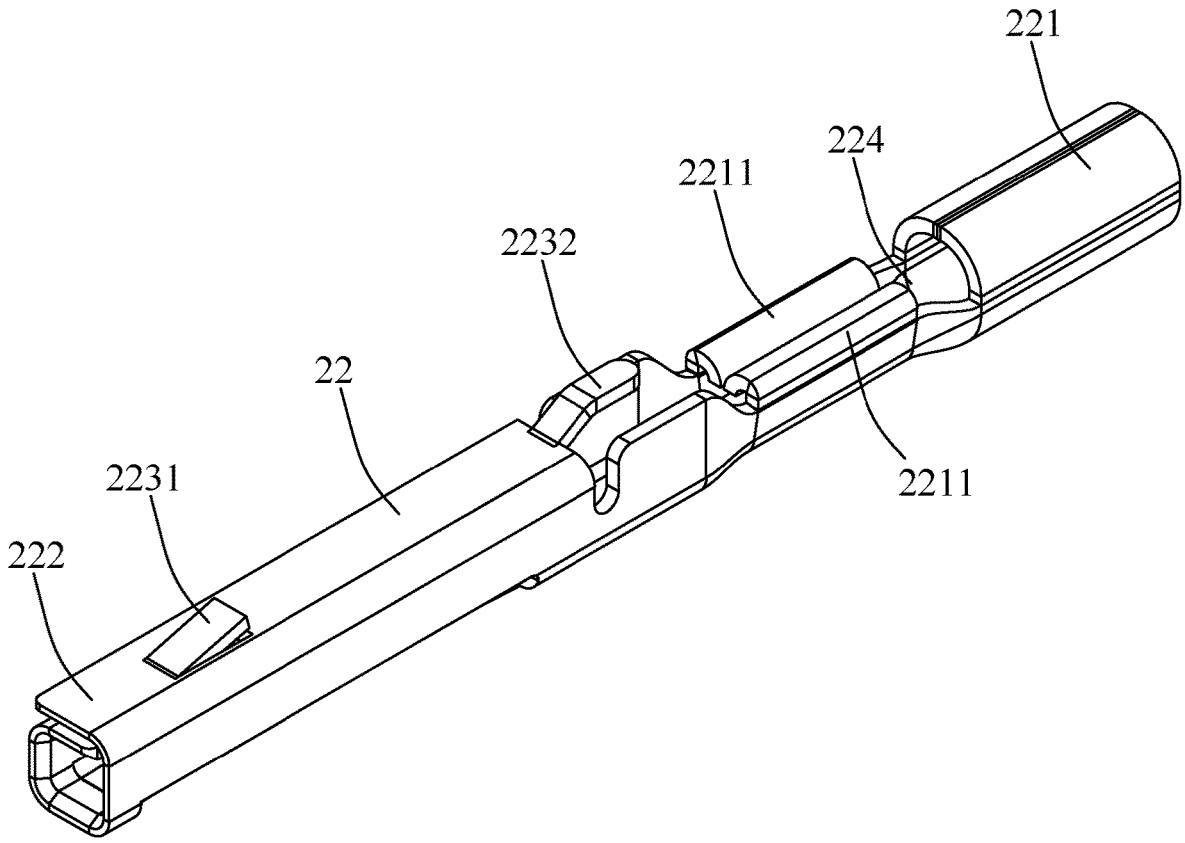
FIG. 5 is a perspective view of a terminal of the plug connector with a connector position assurance device in accordance with the present invention.
Figure 6:
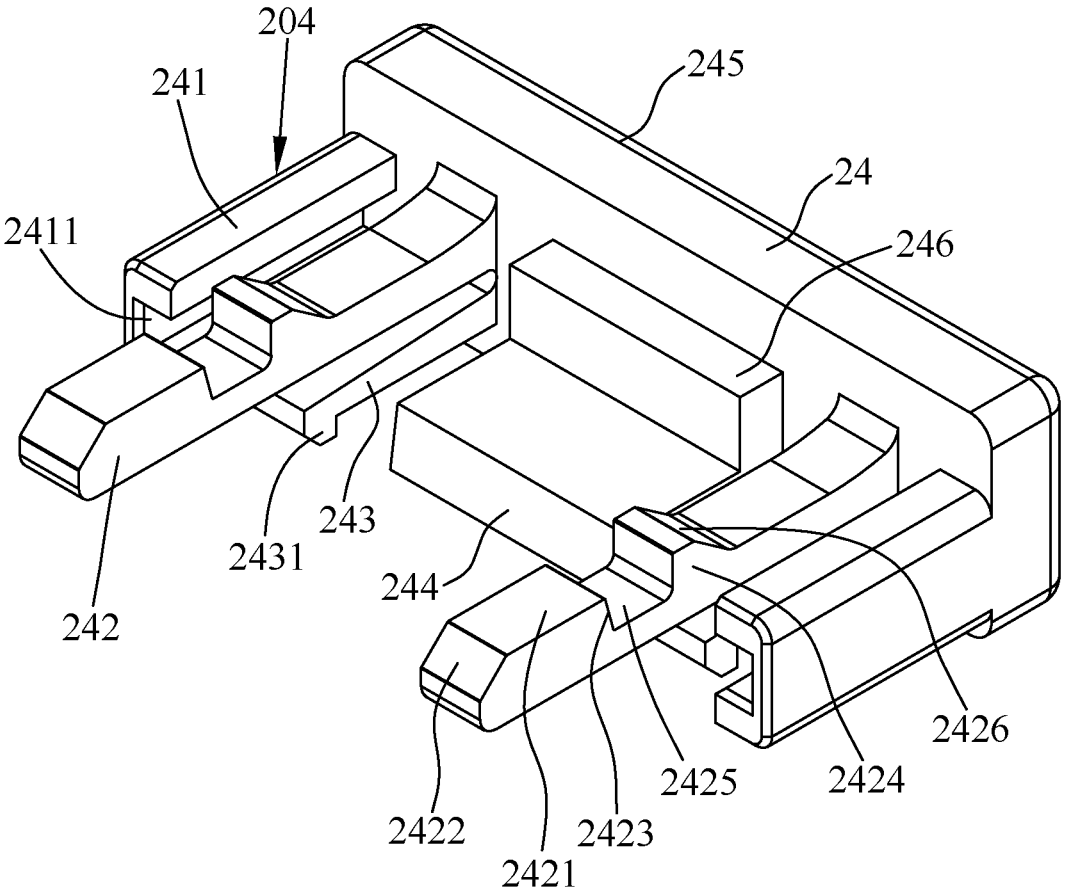
FIG. 6 is a perspective view of a connector position assurance device of the plug connector with a connector position assurance device in accordance with the present invention.

Referring to FIG. 2, FIG. 3 and FIG. 6, the connector position assurance device 24 is formed to ensure that the plug connector with a connector position assurance device 2, and the socket connector 1 are combined with and engaged with each other properly, and the connector position assurance device 24 is movable from a disconnecting status of the plug connector with a connector position assurance device 2, and the socket connector 1 to a connecting status of the plug connector with a connector position assurance device 2, and the socket connector 1. The connector position assurance device 24 has a latching assembly 204 extended rearward and located to at least one side of the connector position assurance device 24, and an abutting block 244 protruded rearward and located adjacent to an inner side of the latching assembly 204. The connector position assurance device 24 has a locating board 245. The latching assembly 204 includes at least one first latch 241. The at least one first latch 241 is extended rearward from at least one side of a rear surface of the locating board 245 of the connector position assurance device 24. A middle of an inner surface of the at least one first latch 241 defines a sliding slot 2411 extending along a lengthwise direction of the at least one first latch 241 and corresponding to the sliding block 2124 of the at least one locking portion 212. The at least one first latch 241 is arranged corresponding to the outer surface of the at least one locking portion 212. The connector position assurance device 24 further has at least one second latch 242 extended rearward from the at least one side of the rear surface of the locating board 245 of the connector position assurance device 24 and located to an inner side of the at least one first latch 241. The connector position assurance device 24 has at least one third latch 243 extended rearward from at least one portion of the locating board which is located under the at least one second latch 242. The at least one third latch 243 is located under the at least one second latch 242. The at least one second latch 242 and the at least one third latch 243 together pass through the locking hole 2121 of the at least one locking portion 212.

In the preferred embodiment, the connector position assurance device 24 has the latching assembly 204 extended rearward and located to two opposite sides of the connector position assurance device 24, and the abutting block 244 protruded rearward and located between two sides of the latching assembly 204. The latching assembly 204 includes two first latches 241. The two first latches 241 are extended rearward from two sides of the rear surface of the locating board 245 of the connector position assurance device 24. Middles of two facing surfaces of the two first latches 241 are recessed oppositely to form two sliding slots 2411 corresponding to the two sliding blocks 2124. The two first latches 241 are arranged corresponding to and clamp the outer surfaces of the two locking portions 212.

The connector position assurance device 24 further has two second latches 242 extended rearward from the two sides of the rear surface of the locating board 245 of the connector position assurance device 24 and located to inner sides of the two first latches 241. The two second latches 242 are located between the two first latches 241. Rears of two tops of the two second latches 242 protrude upward to form two second buckling blocks 2421. Middles of the two tops of the two second latches 242 protrude upward to form two third buckling blocks 2424. A rear of a top surface of each second buckling block 2421 is inclined frontward from bottom to top to form a first inclined plane 2422. A front surface of each second buckling block 2421 is inclined rearward from bottom to top to form a second inclined plane 2423. A buckling groove 2425 is formed between the second buckling block 2421 and the third buckling block 2424 of each second latch 242. A front surface of each third buckling block 2424 is inclined rearward from bottom to top to form a third inclined plane 2426.

The connector position assurance device 24 has two third latches 243 extended rearward from two portions of the locating board 245 of the connector position assurance device 24 which are located under the two second latches 242. The two third latches 243 are located under the two second latches 242. One third latch 243 is located under one second latch 242, and the other third latch 243 is located under the other second latch 242. A free end of a bottom surface of each third latch 243 protrudes downward to form a fourth buckling block 2431. The two second latches 242 and the two third latches 243 are all arranged corresponding to the two locking holes 2121 of the two locking portions 212. A lower portion of the rear surface of the locating board 245 extends rearward to form the abutting block 244. A middle of the rear surface of the locating board 245 extends rearward to form a blocking board 246 connected with a top surface of a front end of the abutting block 244. The abutting block 244 is located between the two second latches 242 and located between the two third latches 243. The abutting block 244 is arranged corresponding to the locating space 214. The abutting block 244 fits with the locating space 214.

Figure 7:
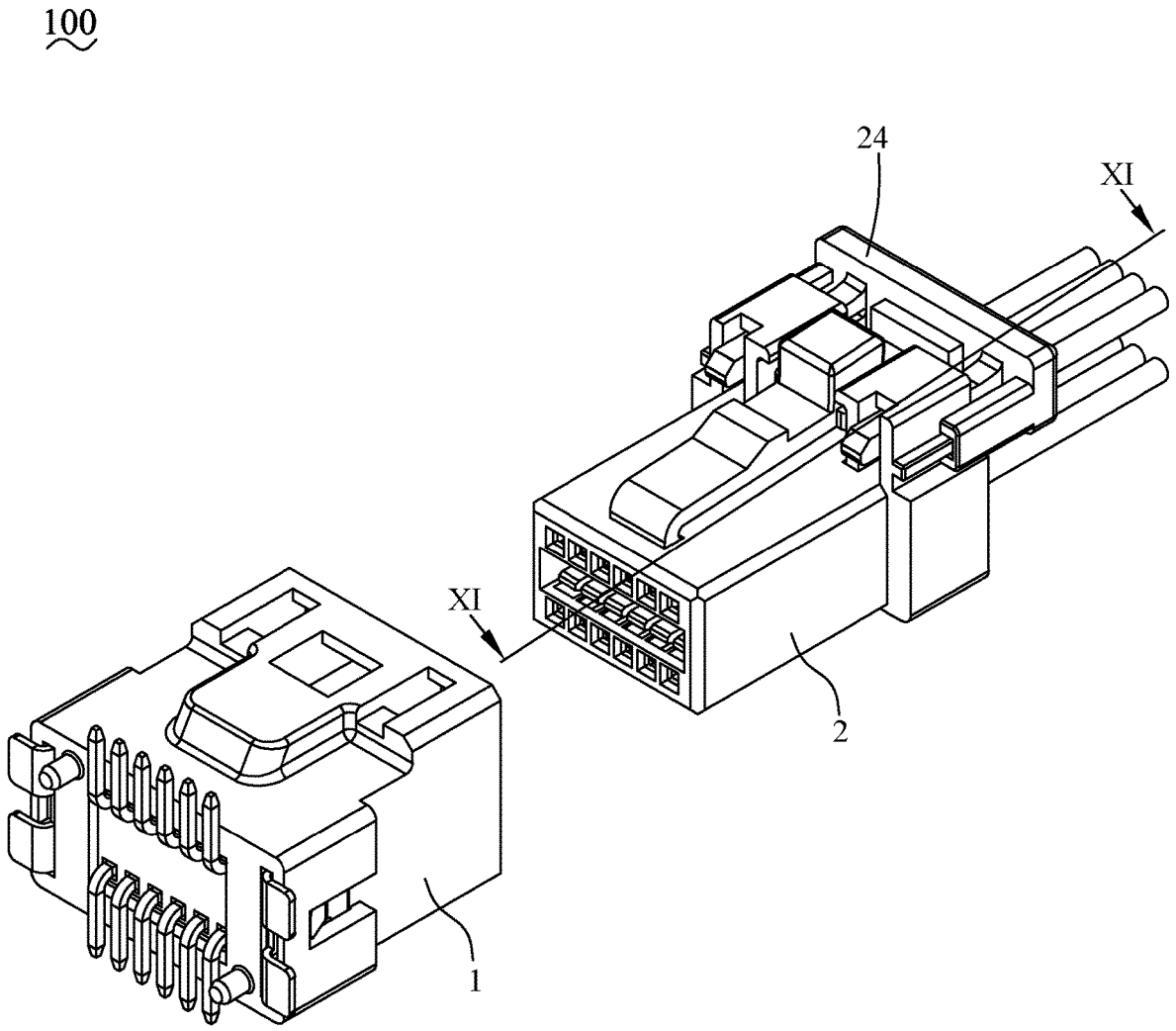
FIG. 7 is a perspective view of the plug connector with a connector position assurance device in accordance with the present invention, wherein the plug connector with a connector position assurance device is disconnected from the socket connector.
Figure 8:
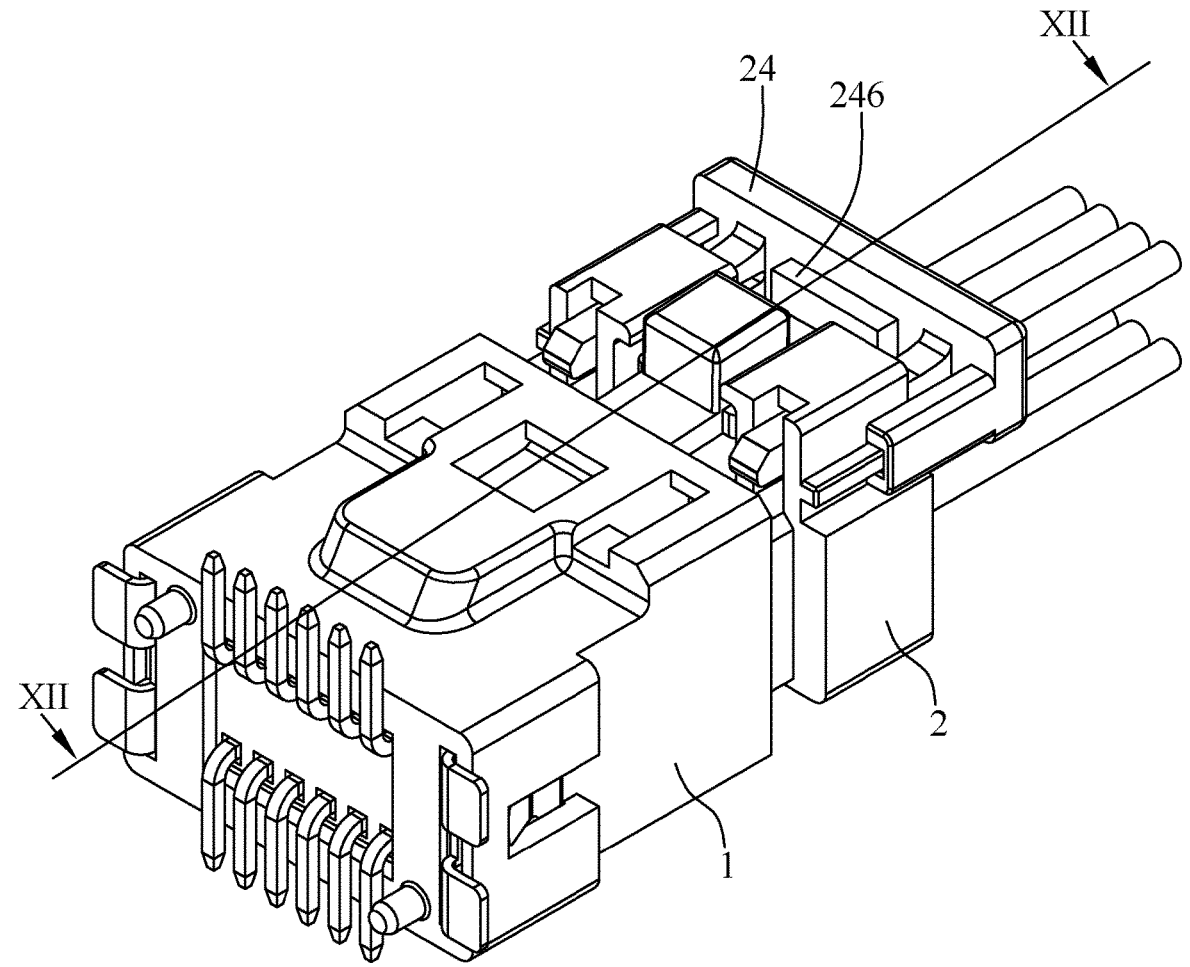
FIG. 8 is a perspective view of the plug connector with a connector position assurance device in accordance with the present invention, wherein the plug connector with a connector position assurance device is inserted into the socket connector.
Figure 9:
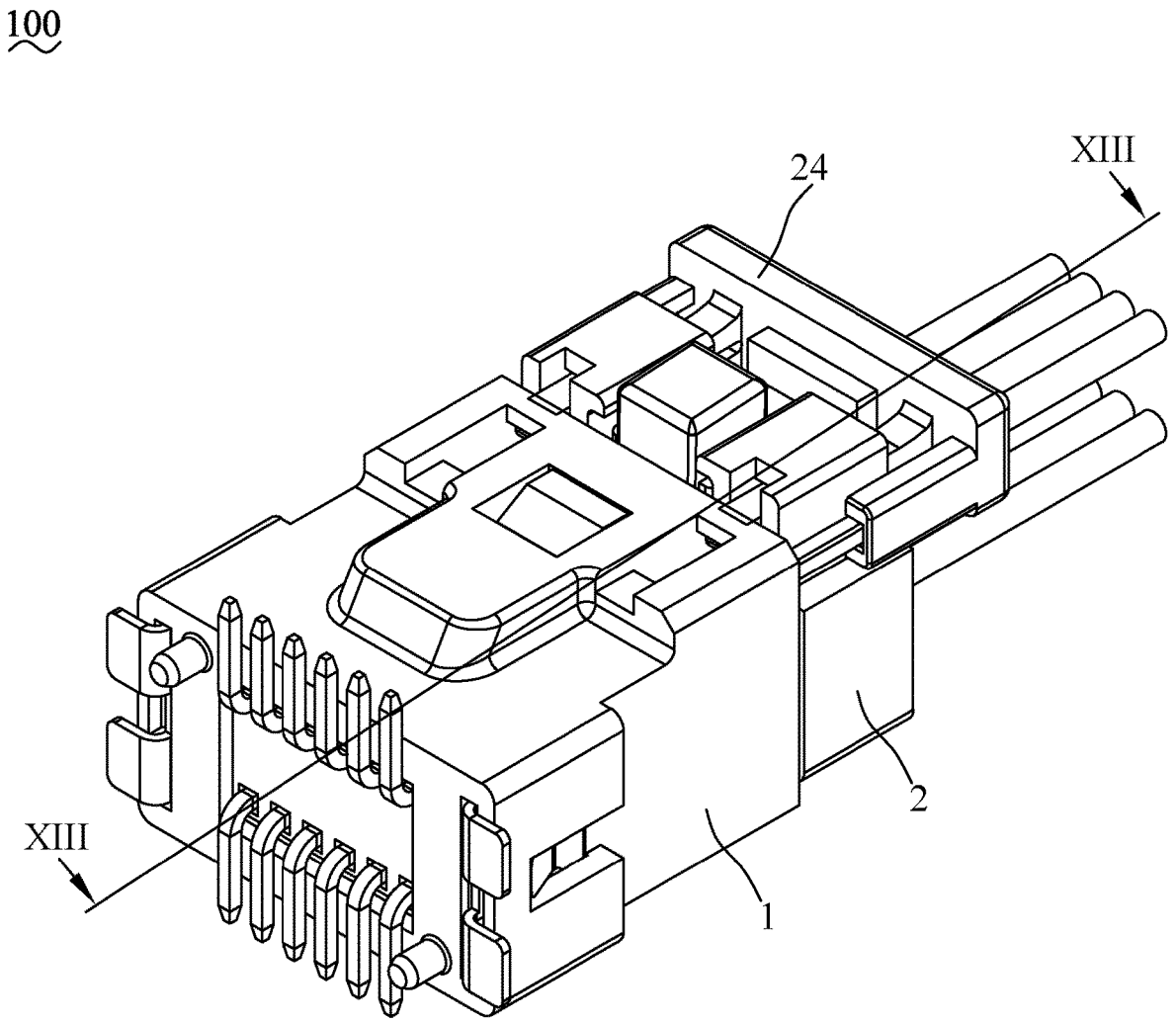
FIG. 9 is a perspective view of the plug connector with a connector position assurance device in accordance with the present invention, wherein the plug connector with a connector position assurance device is assembled with the socket connector.
Figure 10:
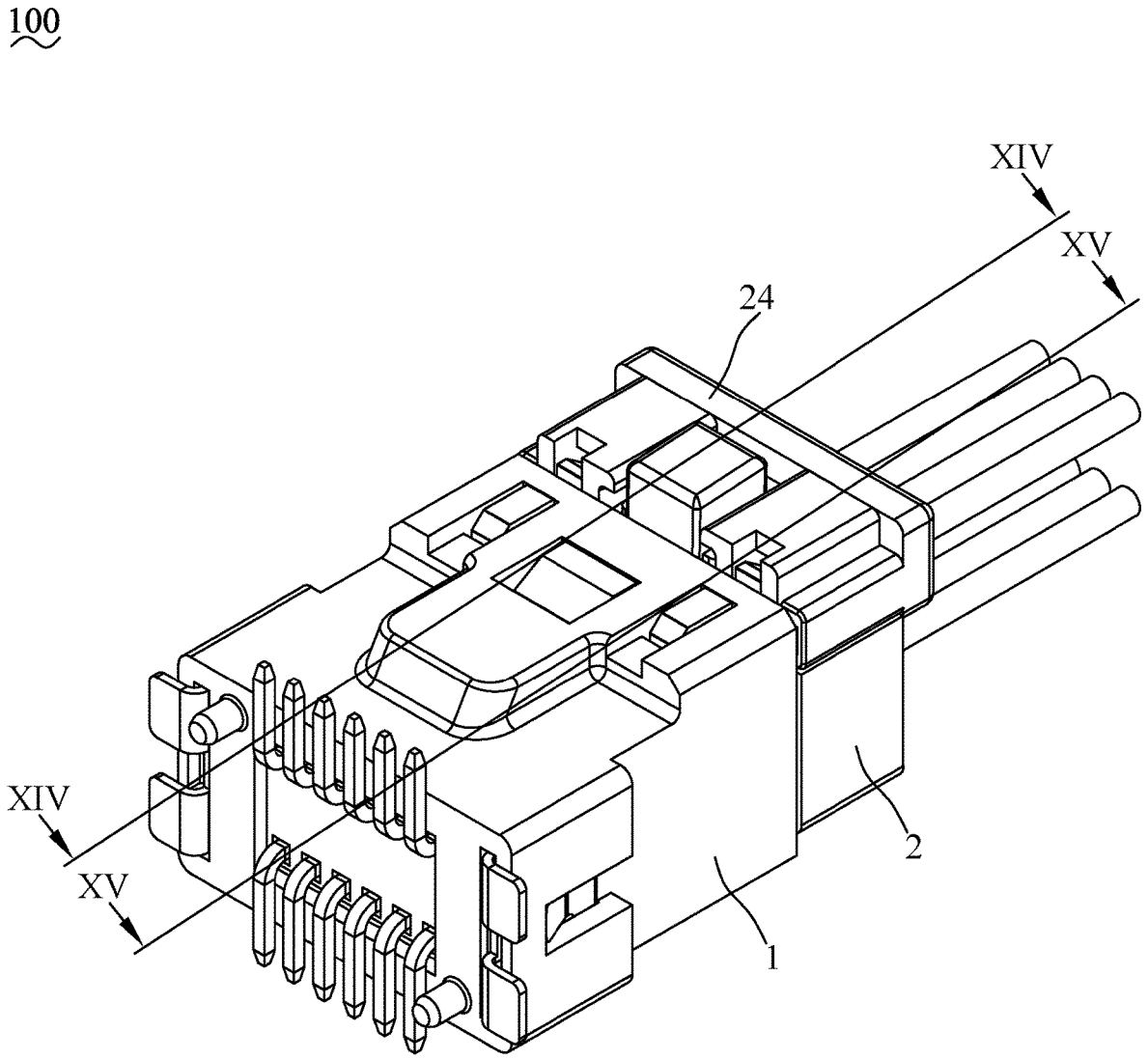
FIG. 10 is a perspective view of the plug connector with a connector position assurance device in accordance with the present invention, wherein the connector position assurance device of the plug connector with a connector position assurance device is combined with the socket connector to make the plug connector with a connector position assurance device, and the socket connector be located in a connecting status.
Figure 11:
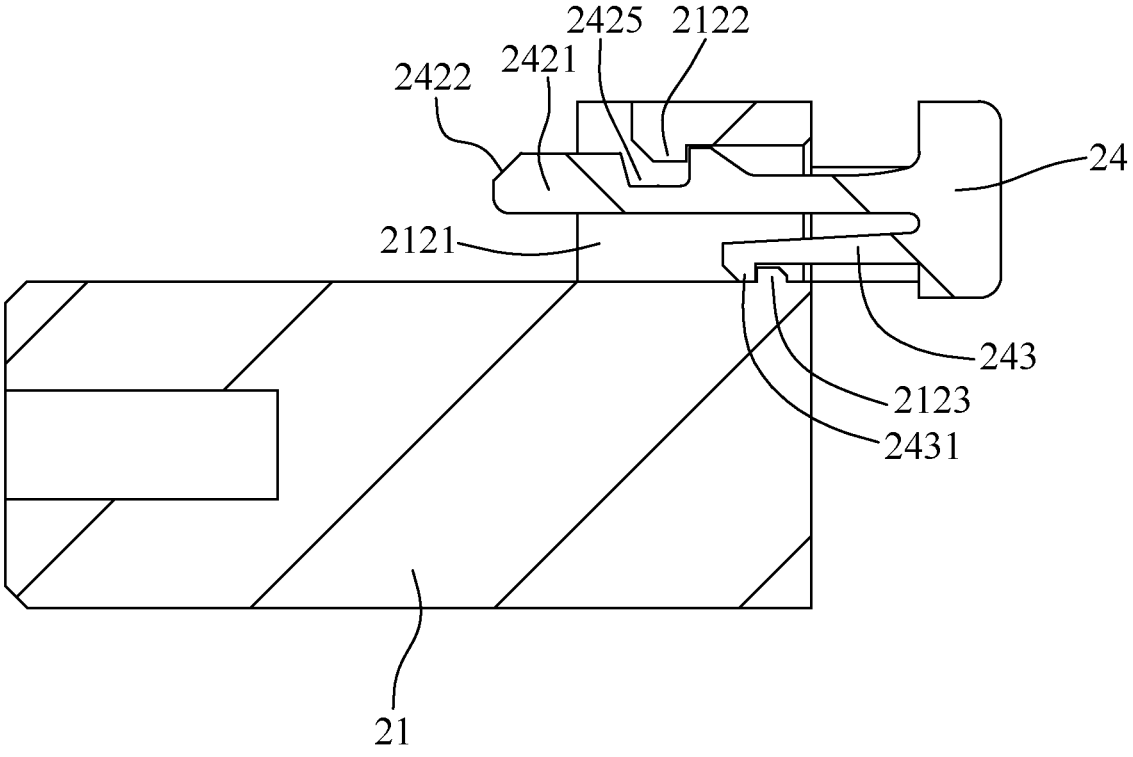
FIG. 11 is a sectional view of the plug connector with a connector position assurance device of the connector assembly along a line XI-XI of FIG. 7.
Figure 12:
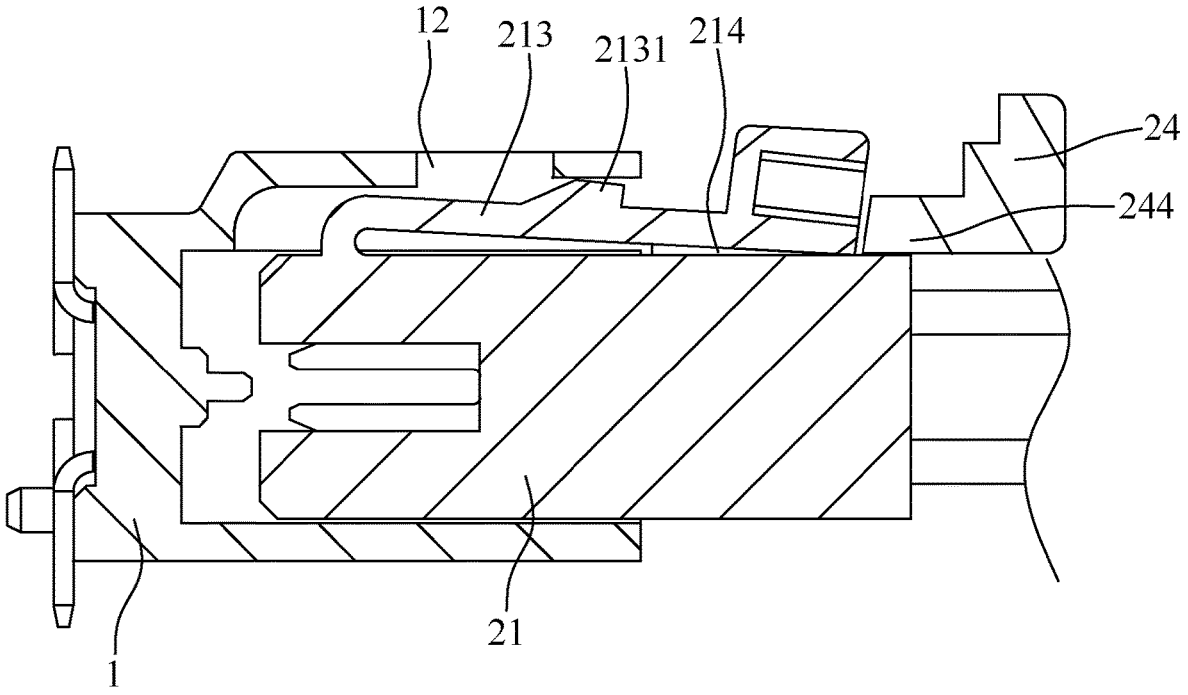
FIG. 12 is a sectional view of the plug connector with a connector position assurance device, and the socket connector along a line XII-XII of FIG. 8.

Referring to FIG. 7 to FIG. 16, the disconnecting status of the plug connector with a connector position assurance device 2, and the socket connector 1 is shown in FIG. 7. When the plug connector with a connector position assurance device 2 is disengaged from the socket connector 1, the connector position assurance device 24 is located at a status of being disconnected from the connector assembly 100. The two sliding blocks 2124 are partially assembled in the two sliding slots 2411 of the two first latches 241. The two first latches 241 are longitudinally movable at the time of the two sliding slots 2411 sliding along the two sliding blocks 2124. The two second latches 242 and the two third latches 243 pass through the two locking holes 2121 of the two locking portions 212. The one second latch 242 and the one third latch 243 together pass through the locking hole 2121 of one locking portion 212. The other second latch 242 and the other third latch 243 together pass through the locking hole 2121 of the other locking portion 212. The two first locking blocks 2122 of the two locking holes 2121 are buckled in the two buckling grooves 2425 of the two second latches 242. The fourth buckling blocks 2431 of the two third latches 243 are blocked by the two second locking blocks 2123 of the two locking holes 2121, so that the connector position assurance device 24 is assembled to the plug connector with a connector position assurance device 2. At the moment, the abutting block 244 of the connector position assurance device 24 is still located outside the locating space 214.

Referring to FIG. 8 to FIG. 16, the plug connector with a connector position assurance device 2 is partially engaged with the socket connector 1, and the connector position assurance device 24 is in the status of being disconnected from the connector assembly 100. When the plug connector with a connector position assurance device 2 is inserted into the insertion space 11 of the socket connector 1, a front end of the buckling portion 213 contacts with an inner surface of a top wall of the insertion space 11 in advance, and when the plug connector with a connector position assurance device 2 continues being inserted into the insertion space 11, the buckling portion 213 will be limited by the top wall of the insertion space 11 and move downward to compress the locating space 214, at the moment, the abutting block 244 is still without entering the locating space 214, so the buckling portion 213 is without being affected to move downward to make the plug connector with a connector position assurance device 2 continue entering the insertion space 11. And then, the plurality of the contact pins 14 of the socket connector 1 contact with the plurality of the terminals 22 of the plug connector with a connector position assurance device 2, the first buckling block 2131 is buckled in the first buckling hole 12, at the same time, the buckling portion 213 will move upward to return to an original position to expose the locating space 214 so as to complete connecting the socket connector 1 with the plug connector with a connector position assurance device 2.

Referring to FIG. 6 to FIG. 16, at last, the connector position assurance device 24 is pushed rearward again, in a process of the first inclined planes 2422 of the two second latches 242 moving rearward, the first inclined planes 2422 of the two second latches 242 are guided into the insertion space 11 by the first guiding surfaces 131 of the two second buckling holes 13 and contact with the top wall of the insertion space 11, and the top wall of the insertion space 11 presses against the two second latches 242 to make the two second latches 242 bent downward at the time of the two second latches 242 being pushing rearward. And then, the second buckling blocks 2421 of the two second latches 242 are buckled in the two second buckling holes 13 of the socket connector 1 to make the two second latches 242 return to initial positions. The abutting block 244 moves into the locating space 214, the buckling portion 213 is pressable towards the abutting block 244, the front end of the buckling portion 213 abuts against the abutting block 244 at the time of the front end of the buckling portion 213 being pressed downward on the abutting block 244, at the moment, the locating space 214 is filled up to make the buckling portion 213 be unable to be pressed downward and towards the abutting block 244, and a connecting status of the socket connector 1, and the plug connector with a connector position assurance device 2 is maintained. The plug connector with a connector position assurance device 2 is inserted into the socket connector 1 conveniently by actions of the third inclined planes 2426 of the two third buckling blocks 2424. The third inclined planes 2426 of the two third buckling blocks 2424 are spaced from the second guiding surfaces 2120 of the two locking holes 2121.

At least one side of the latching assembly 204 is arranged corresponding to the outer surface of the at least one locking portion 212, the sliding block 2124 of the at least one locking portion 212 is assembled in the sliding slot 2411 of the at least one first latch 241. The two sides of the latching assembly 204 are arranged corresponding to the outer surfaces of the two locking portions 212, the two sliding blocks 2124 are assembled in the two sliding slots 2411 of the two first latches 241, and the latching assembly 204 is combined with the socket connector 1. The blocking board 246 is located in front of the front end of the buckling portion 213. The second buckling blocks 2421 of the two second latches 242 and the third buckling blocks 2424 of the two second latches 242 are beyond the two first locking blocks 2122. The fourth buckling blocks 2431 of the two third latches 243 are beyond the two second locking blocks 2123. The second buckling blocks 2421 of the two second latches 242, the third buckling blocks 2424 of the two second latches 242 and the fourth buckling blocks 2431 of the two third latches 243 are inserted into the two locking holes 2121 of the two locking portions 212.

When a user wants to withdraw the plug connector with a connector position assurance device 2 from the socket connector 1, the connector position assurance device 24 is pulled frontward to be out of the connector assembly 100, and during a process of the second inclined planes 2423 of the two second latches 242 being withdrawn from the connector assembly 100 along the second guiding surfaces 2120 of the two locking holes 2121, the second inclined planes 2423 of the two second latches 242 contact with the two first locking blocks 2122 of the two locking holes 2121 to make the two second latches 242 bent downward at the time of the two second latches 242 being withdrawn from the connector assembly 100. Meanwhile, the abutting block 244 moves to be out of the locating space 214, and thus the first buckling block 2131 is withdrawn downward from the first buckling hole 12 is able to move downward to exit the first buckling hole 12 to make the buckling portion 213 move downward. Because the fourth buckling blocks 2431 of the two third latches 243 are buckled with the two second locking blocks 2123 of the two locking holes 2121, in a process of the connector position assurance device 24 being withdrawn, the plug connector with a connector position assurance device 2 is driven by the connector position assurance device 24 to move out of and withdrawn from the insertion space 11, the buckling portion 213 moves out of and is withdrawn from the insertion space 11, the plurality of the terminals 22 are disengaged from the plurality of the contact pins 14, and then the plug connector with a connector position assurance device 2 is withdrawn from and is disengaged from the socket connector 1.

As described above, when the plug connector with a connector position assurance device 2 is inserted into the socket connector 1, the abutting block 244 keeps contacting with and abutting against the buckling portion 213 by virtue of the connector position assurance device 24 being assembled to the plug connector with a connector position assurance device 2, and the socket connector 1, so that the plug connector with a connector position assurance device 2, and the socket connector 1 of the connector assembly 100 are capable of maintaining an insertion and connection status between the plug connector with a connector position assurance device 2, and the socket connector 1.

What is claimed is:

1. A plug connector with a connector position assurance device adapted for being docked with a socket connector, comprising:

a main body having a plurality of terminal slots longitudinally penetrating through a front surface and a rear surface of the main body, two sides of a top of the main body protruding upward to form two locking portions spaced from each other, a rear of the top of the main body being protruded upward and then being bent frontward to form a buckling portion projecting into an interval between the two locking portions, the top of the main body being spaced from a front end of the buckling portion and the two locking portions to form a locating space among the top of the main body, the front end of the buckling portion and the two locking portions;

a plurality of terminals assembled in the plurality of the terminal slots, two opposite ends of each terminal having a connecting end and a fitting end;

a plurality of cables connected with the connecting ends of the plurality of the terminals; and a connector position assurance device having a latching assembly extended rearward and located to two opposite sides of the connector position assurance device, and an abutting block protruded rearward and located between two sides of the latching assembly, the abutting block being arranged corresponding to the locating space, when the plug connector with the connector position assurance device is inserted into the socket connector, the two sides of the latching assembly being arranged corresponding to outer surfaces of the two locking portions, and the latching assembly being combined with the socket connector, the abutting block moving into the locating space, the front end of the buckling portion abutting against the abutting block at the time of the front end of the buckling portion being pressed downward on the abutting block, at the moment, the locating space being filled up to make the buckling portion be unable to be pressed downward and towards the abutting block, and a connecting status of the socket connector, and the plug connector with a connector position assurance device being maintained.

2. The plug connector with a connector position assurance device as claimed in claim 1, wherein the socket connector includes a base body, a middle of a front of the base body is recessed rearward to form an insertion space for receiving the plug connector with a connector position assurance device, a front of a top of the base body defines a first buckling hole vertically penetrating through the front of the top of the base body and communicated with the insertion space, a middle of the buckling portion is arched upward to form a first buckling block, the first buckling block is positioned corresponding to the first buckling hole.

3. The plug connector with a connector position assurance device as claimed in claim 2, wherein lower portions of the outer surfaces of the two locking portions protrude outward to form two sliding blocks, the connector position assurance device has a locating board, the latching assembly includes two first latches extended rearward from two sides of a rear surface of the locating board, middles of two facing surfaces of the two first latches are recessed oppositely to form two sliding slots corresponding to the two sliding blocks, the two first latches are arranged corresponding to and clamp the outer surfaces of the two locking portions, the two sliding blocks are assembled in the two sliding slots of the two first latches, the two first latches are longitudinally movable at the time of the two sliding slots sliding along the two sliding blocks.

4. The plug connector with a connector position assurance device as claimed in claim 3, wherein the two locking portions define two locking holes longitudinally penetrating through middles of front surfaces and rear surfaces of the two locking portions, the connector position assurance device further has two second latches extended rearward from the two sides of the rear surface of the locating board and located to inner sides of the two first latches, the two second latches are located between the two first latches, the connector position assurance device has two third latches extended rearward from two portions of the locating board which are located under the two second latches, the two second latches and the two third latches are all arranged corresponding to the two locking holes of the two locking portions, the two second latches and the two third latches pass through the two locking holes of the two locking portions.

5. The plug connector with a connector position assurance device as claimed in claim 4, wherein rears of top walls of the two locking holes protrude downward to form two first locking blocks, fronts of bottom walls of the two locking holes protrude upward to form two second locking blocks, rears of two tops of the two second latches protrude upward to form two second buckling blocks, middles of the two tops of the two second latches protrude upward to form two third buckling blocks, a free end of a bottom surface of each third latch protrudes downward to form a fourth buckling block, the second buckling blocks and the third buckling blocks of the two second latches are beyond the two first locking blocks, the fourth buckling blocks of the two third latches are beyond the two second locking blocks, the second buckling blocks and the third buckling blocks of the two second latches and the fourth buckling blocks of the two third latches are inserted into the two locking holes of the two locking portions.

6. The plug connector with a connector position assurance device as claimed in claim 5, wherein two sides of the top of the base body of the socket connector define two second buckling holes vertically penetrating through the top of the base body and communicated with the insertion space, the second buckling blocks of the two second latches are buckled in the two second buckling holes of the socket connector.

7. The plug connector with a connector position assurance device as claimed in claim 5, wherein a lower portion of the rear surface of the locating board extends rearward to form the abutting block, a middle of the rear surface of the locating board extends rearward to form a blocking board connected with a top surface of a front end of the abutting block, the blocking board is located in front of the front end of the buckling portion.

8. A connector assembly, comprising:

a socket connector; and a plug connector with a connector position assurance device, including:

a main body having a plurality of terminal slots longitudinally penetrating through a front surface and a rear surface of the main body, two sides of a top of the main body protruding upward to form two locking portions spaced from each other, a rear of the top of the main body being protruded upward and then being bent frontward to form a buckling portion projecting into an interval between the two locking portions, the top of the main body being spaced from a front end of the buckling portion and the two locking portions to form a locating space among the top of the main body, the front end of the buckling portion and the two locking portions;

a plurality of terminals assembled in the plurality of the terminal slots, two opposite ends of each terminal having a connecting end and a fitting end;

a plurality of cables connected with the connecting ends of the plurality of the terminals; and a connector position assurance device having a latching assembly extended rearward and located to two opposite sides of the connector position assurance device, and an abutting block protruded rearward and located between two sides of the latching assembly, the abutting block being arranged corresponding to the locating space, when the plug connector with the connector position assurance device is inserted into the socket connector, the two sides of the latching assembly being arranged corresponding to outer surfaces of the two locking portions, and the latching assembly being combined with the socket connector, the abutting block moving into the locating space, the front end of the buckling portion abutting against the abutting block at the time of the front end of the buckling portion being pressed downward on the abutting block, at the moment, the locating space being filled up to make the buckling portion be unable to be pressed downward and towards the abutting block, and a connecting status of the socket connector, and the plug connector with a connector position assurance device being maintained.

9. A plug connector with a connector position assurance device adapted for being docked with a socket connector, comprising:

a main body having a plurality of terminal slots longitudinally penetrating through a front surface and a rear surface of the main body, at least one side of a top of the main body protruding upward to form at least one locking portion, a rear of the top of the main body being protruded upward and then being bent frontward to form a buckling portion extending to one side of the at least one locking portion, the top of the main body being spaced from a front end of the buckling portion and the at least one locking portion to form a locating space among the top of the main body, the front end of the buckling portion and the at least one locking portion;

a plurality of terminals assembled in the plurality of the terminal slots, two opposite ends of each terminal having a connecting end and a fitting end;

a plurality of cables connected with the connecting ends of the plurality of the terminals; and a connector position assurance device having a latching assembly extended rearward and located to at least one side of the connector position assurance device, and an abutting block protruded rearward and adjacent to an inner side of the latching assembly, the abutting block being arranged corresponding to the locating space, when the plug connector with the connector position assurance device is inserted into the socket connector, the latching assembly being arranged corresponding to an outer surface of the at least one locking portion, and the latching assembly being combined with the socket connector, the abutting block moving into the locating space, the front end of the buckling portion abutting against the abutting block at the time of the front end of the buckling portion being pressed downward on the abutting block, at the moment, the locating space being filled up to make the buckling portion be unable to be pressed downward and towards the abutting block, and a connecting status of the socket connector, and the plug connector with a connector position assurance device being maintained.

10. The plug connector with a connector position assurance device as claimed in claim 9, wherein a lower portion of the outer surface of the at least one locking portion protrudes outward to form a sliding block, the latching assembly includes at least one first latch, a middle of an inner surface of the at least one first latch defines a sliding slot extending along a lengthwise direction of the at least one first latch and corresponding to the sliding block of the at least one locking portion, the at least one first latch is arranged corresponding to the outer surface of the at least one locking portion, the sliding block of the at least one locking portion is assembled in the sliding slot of the at least one first latch.

11. The plug connector with a connector position assurance device as claimed in claim 10, wherein the at least one locking portion defines a locking hole longitudinally penetrating through middles of a front surface and a rear surface of the at least one locking portion, the connector position assurance device has a locating board, the at least one first latch is extended rearward from at least one side of a rear surface of the locating board, the connector position assurance device further has at least one second latch extended rearward from the at least one side of the rear surface of the locating board and located to an inner side of the at least one first latch, the connector position assurance device has at least one third latch extended rearward from at least one portion of the locating board which is located under the at least one second latch, the at least one second latch and the at least one third latch together pass through the locking hole of the at least one locking portion.

* * * * *